US009185982B2

(12) United States Patent
Kilzer

(10) Patent No.: US 9,185,982 B2
(45) Date of Patent: Nov. 17, 2015

(54) CHAIR FOR OUTDOOR USE

(71) Applicant: Susan B. Kilzer, Chapel Hill, NC (US)

(72) Inventor: Susan B. Kilzer, Chapel Hill, NC (US)

( * ) Notice: Subject to any disclaimer, the term of this patent is extended or adjusted under 35 U.S.C. 154(b) by 202 days.

(21) Appl. No.: 13/718,321

(22) Filed: Dec. 18, 2012

(65) Prior Publication Data

US 2013/0154315 A1 Jun. 20, 2013

Related U.S. Application Data

(60) Provisional application No. 61/577,359, filed on Dec. 19, 2011.

(51) Int. Cl.

| | |
|---|---|
| ***A47C 7/62*** | (2006.01) |
| ***A47C 1/022*** | (2006.01) |
| ***A47C 1/024*** | (2006.01) |
| ***A47C 1/034*** | (2006.01) |
| ***A47C 1/14*** | (2006.01) |
| ***A47C 4/04*** | (2006.01) |
| ***A47C 7/66*** | (2006.01) |

(52) U.S. Cl.

CPC ..... *A47C 1/022* (2013.01); *A47C 1/024* (2013.01); *A47C 1/034* (2013.01); *A47C 1/143* (2013.01); *A47C 4/04* (2013.01); *A47C 7/66* (2013.01)

(58) Field of Classification Search

CPC ..... A47C 3/18; A47C 4/286; A47C 7/66
USPC ..... 297/16.2, 184.1, 344.22
See application file for complete search history.

(56) References Cited

U.S. PATENT DOCUMENTS

| | | | | |
|---|---|---|---|---|
| 4,200,166 | A * | 4/1980 | Hansen | 180/315 |
| 4,473,913 | A | 10/1984 | Ylvisaker | |
| 4,781,413 | A * | 11/1988 | Shumack, Jr. | 297/252 |
| 4,876,756 | A | 10/1989 | Vaccaro | |
| 4,921,301 | A | 5/1990 | Haynes | |
| 5,029,349 | A | 7/1991 | Hamilton | |
| 5,237,713 | A | 8/1993 | Prager | |
| 5,297,850 | A | 3/1994 | Guleserian | |
| 5,395,157 | A * | 3/1995 | Rollo et al. | 297/344.26 |
| 5,515,564 | A | 5/1996 | Lyons | |
| 5,947,561 | A | 9/1999 | Ryan | |
| 5,950,259 | A | 9/1999 | Boggs | |
| 6,059,365 | A | 5/2000 | Diamond | |
| 6,213,555 | B1 | 4/2001 | Sulpizio et al. | |
| 6,253,396 | B1 | 7/2001 | Weston | |
| 6,935,694 | B2 | 8/2005 | Turner | |
| 7,040,334 | B2 | 5/2006 | Pham | |
| 7,207,622 | B2 | 4/2007 | Cohan et al. | |
| 7,216,385 | B2 | 5/2007 | Hill | |
| 7,367,071 | B1 | 5/2008 | Yesalusky, Jr. | |
| 8,002,349 | B1 | 8/2011 | Pizzuto | |
| 8,449,026 | B1 * | 5/2013 | Gutierrez et al. | 297/16.2 |
| 2002/0124310 | A1 | 9/2002 | Takeuchi | |

(Continued)

*Primary Examiner* — Matthew Ing
(74) *Attorney, Agent, or Firm* — Michael G. Johnston; Moore and Van Allen PLLC

(57) ABSTRACT

Embodiments described relate generally to chairs for outdoor use. For example, a chair is provided having elbow pockets/channels, a media compartment with collapsible shade and ventilation, a solar powered media charging station, and a mid-section/lumbar support device. In some embodiments, the chair is a folding chair. In at least some embodiments, the chair provides a selection of seated positions for the user. In various embodiments, the chair is a lounge chair, a folding lounge chair, a sand chair (seat height less than 9"), a folding sand chair, an elevated chair (seat height 16" or higher), and a folding elevated chair.

18 Claims, 13 Drawing Sheets

(56) References Cited

U.S. PATENT DOCUMENTS

2006/0054207 A1 3/2006 Wootliff
2011/0072581 A1 3/2011 Villa et al.
2011/0138536 A1 6/2011 Wernqvist et al.

* cited by examiner

CHAIR FOR OUTDOOR USE

CLAIM OF PRIORITY UNDER 35 U.S.C. §119

The present application for patent claims priority to and the benefit of the filing date of U.S. Provisional Application No. 61/577,359, entitled "CHAIR FOR OUTDOOR USE" filed Dec. 19, 2011, and hereby expressly incorporated by reference herein.

FIELD OF THE INVENTION

The instant invention relates generally to outdoor furniture, particularly chairs, and more specifically it relates to fully reclining chairs, including chaise lounge chairs.

BACKGROUND

Numerous chairs intended for outdoor use have been provided. Some outdoor chairs, such as portable folding chaise lounge chairs, are adapted to be used by people lying prone in a horizontal plane and trying to read.

While prior chairs have been directed to resolving such problems as reading in the horizontal prone position or providing shade to the user's head, there is no prior chair which attempts to solve the problems of reading, in the bright sun, and engaging in other activities such as watching kids, having conversations, and enjoying the scenery, especially while in a horizontal prone position. Further, the prior art chairs fail to create an inverted (below horizontal) prone position for use in a lounge chair for maximum comfort while reading, watching kids, having conversations, and enjoying the scenery in the prone position and which have elbow pockets for further lowering the user's upper body in the horizontal and inverted (below horizontal) prone positions. Embodiments of the present invention are directed to solving these problems.

SUMMARY OF THE INVENTION

Embodiments of the invention provide a chair with a back that declines to or below the horizontal, the chair having elbow pockets/channels, a media compartment with collapsible shade and ventilation, a solar powered media charging station, and mid-section/lumbar support. In at least some embodiments, the chair provides a variety of seated positions for the user. The variety of seated positions can be provided by enabling adjustment of the section of the chair against which the user's back rests. In some embodiments, the chair does not have arms or arm rests. In some embodiments, the chair includes arms or arm rests.

In some embodiments, the chair is a folding chair. In some embodiments, the chair is portable. In some embodiments, the portability is supplied via rollers or wheels on at least some of the parts of the chair that touch the ground.

In some embodiments, the chair is a lounge chair. The lounge chair comprises two main body sections. The lounge chair further comprises mid-section/lumbar support in the horizontal prone and supine and seated positions. In at least some embodiments, the lounge chair further comprises allowing each main body support section to decline below the horizontal for an extended, inverted prone position, having an inflatable/padded mid-section support, and elbow pockets. In some embodiments, the chair is a folding lounge chair.

In at least some embodiments, the lounge chair provides a selection of positions for the user, spanning a continuum from an upright seated position to a substantially horizontal position, thereby enabling the user to obtain a supine or prone position. The selection of horizontal, inverted, or seated positions can be provided by enabling adjustment of the section of the chair against which the user's back rests. In some embodiments, the section of the lounge chair against which the user sits is also adjustable thereby enabling the user to obtain an inverted prone position with one or both sections declined below the horizontal.

In some embodiments, the lounge chair of the invention provides the elbow pockets, media compartment and shade, and solar power generating technology and media charging station on the chair on each of the two main body support sections, making the chair completely reversible and giving it two charging stations for the user's extended media usage.

In some embodiments, the chair of the invention is a sand chair (seat height less than 9") that sits closer to the ground than a standard chair (seat height 10"-15"). The stature of the sand chair is usually achieved with a leg length that is shorter than that of a standard chair, resulting in a seat height that is lower than that of a standard chair. In some embodiments, the sand chair is a folding chair. In some embodiments, the sand chair is a lounge chair. In some embodiments, the sand chair is a folding lounge chair. In at least some embodiments, the sand chair comprises a media compartment with collapsible shade and ventilation, a solar powered media charging station, and lumbar support in seated positions or mid-section/lumbar support in reclining positions.

In some embodiments, the chair of the invention is a chair that is elevated (seat height 16" or higher), so that the seat of the chair is situated at a higher position relative to the ground than a standard chair (for the convenience of older or less mobile users). The stature of the elevated chair is usually achieved with a leg length that is longer than that of a standard chair, resulting in a seat height that is higher than that of a standard chair. In some embodiments, the elevated chair is a folding chair. In some embodiments, the elevated chair is a lounge chair. In some embodiments, the elevated chair is a folding lounge chair. In at least some embodiments, the elevated chair comprises a media compartment with collapsible shade and ventilation, a solar powered media charging station, and lumbar support in seated positions or mid-section/lumbar support in reclining positions.

BRIEF DESCRIPTION OF THE SEVERAL VIEWS OF THE DRAWINGS

Figure 1:
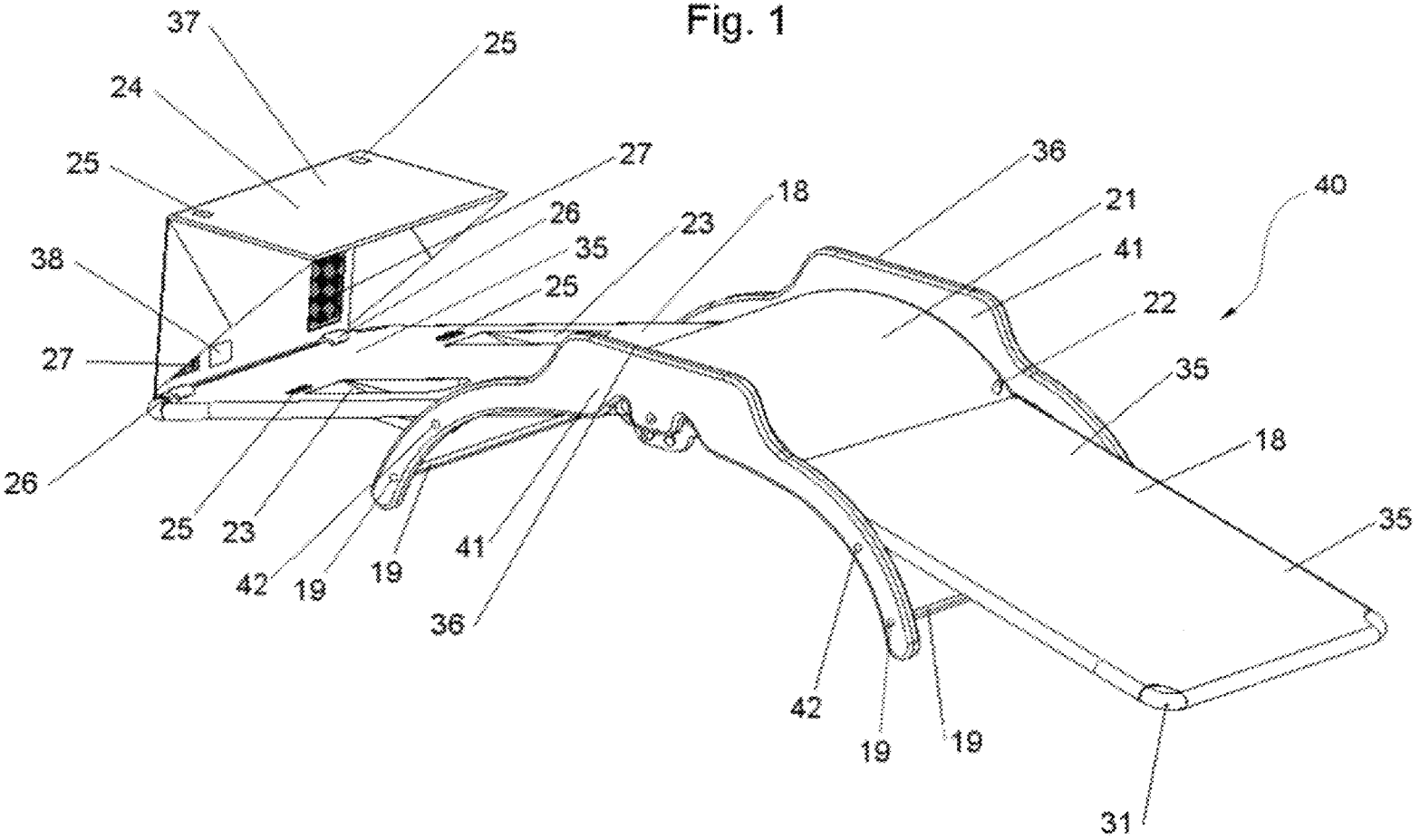
Figure 2:
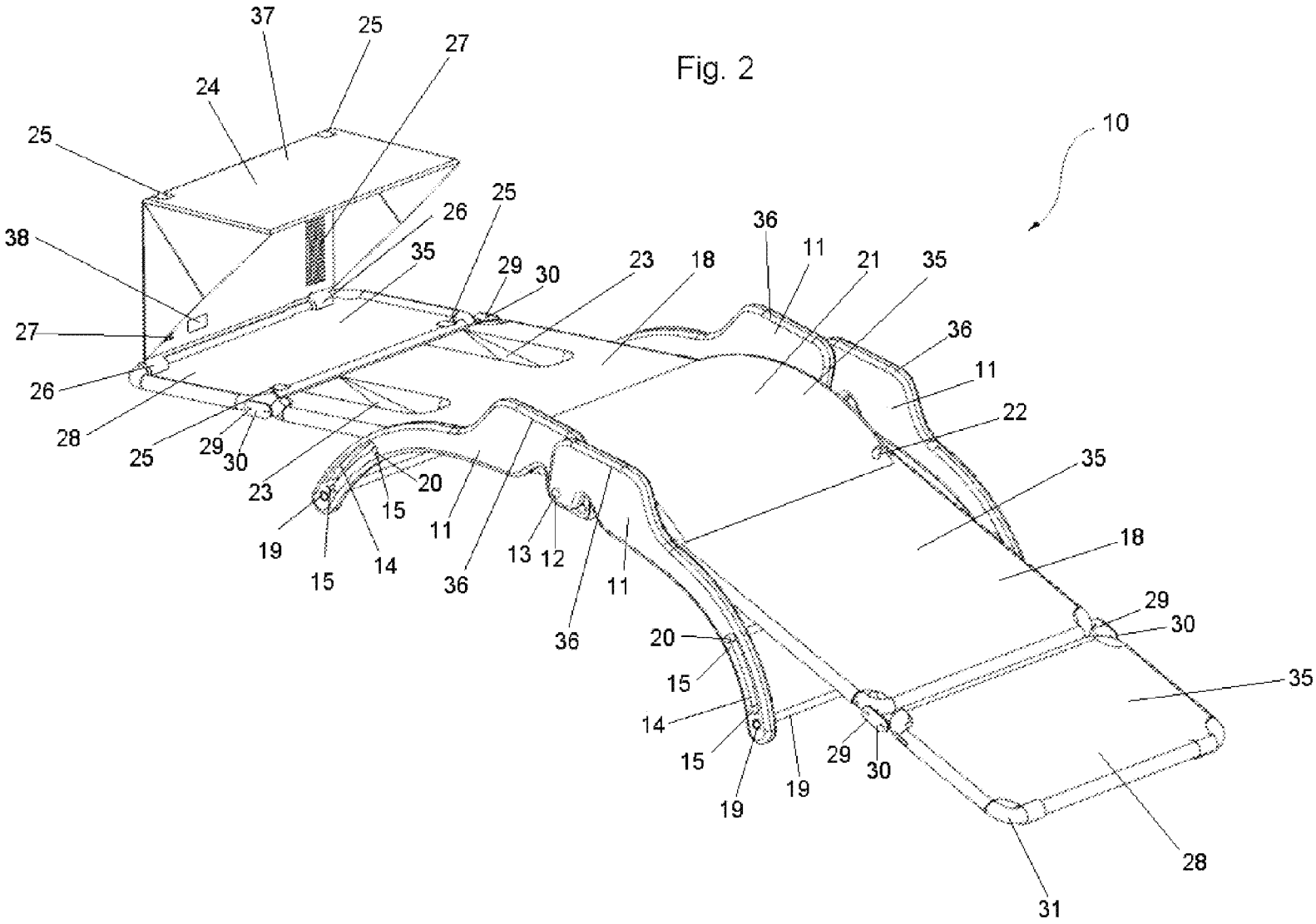
Figure 3:
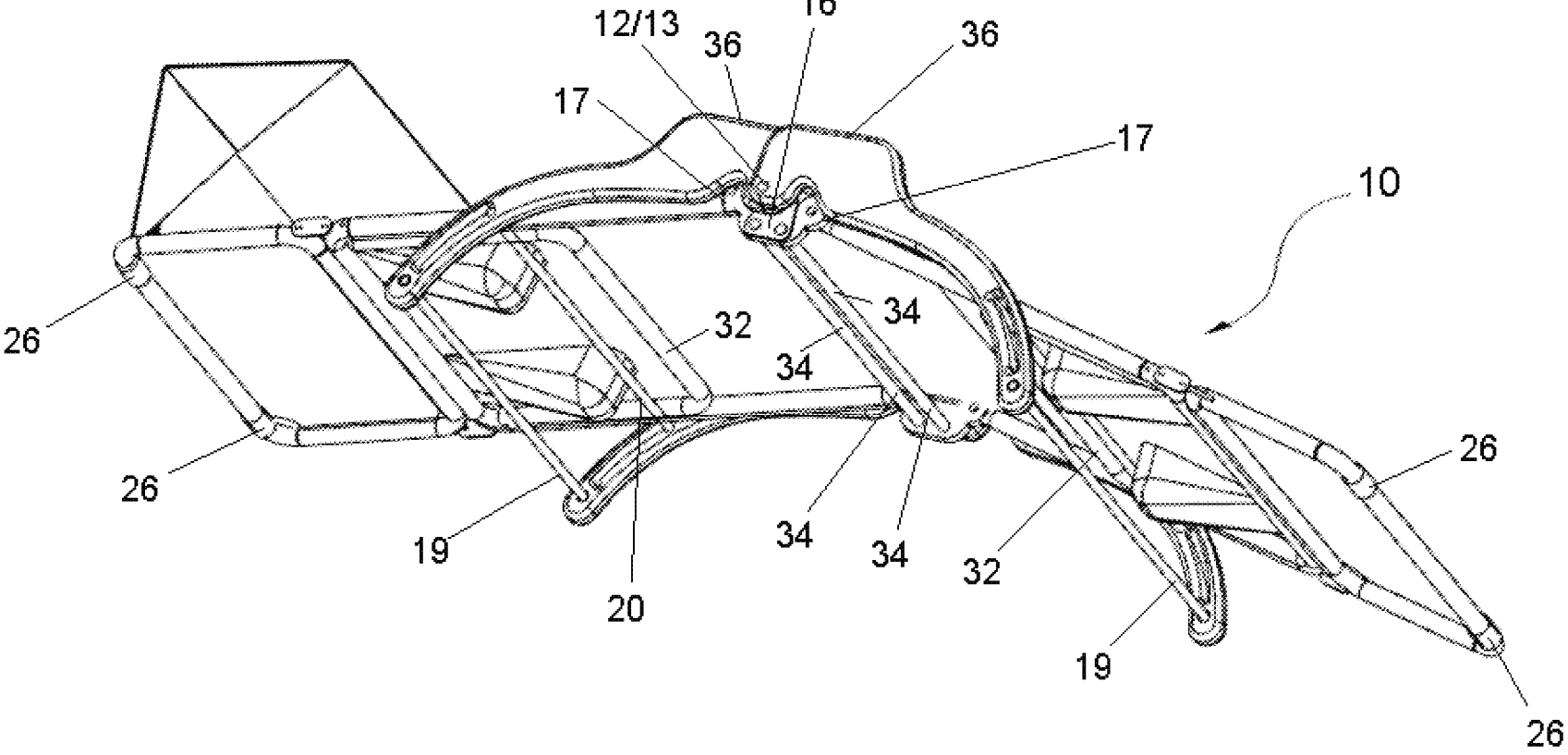
Figure 4:
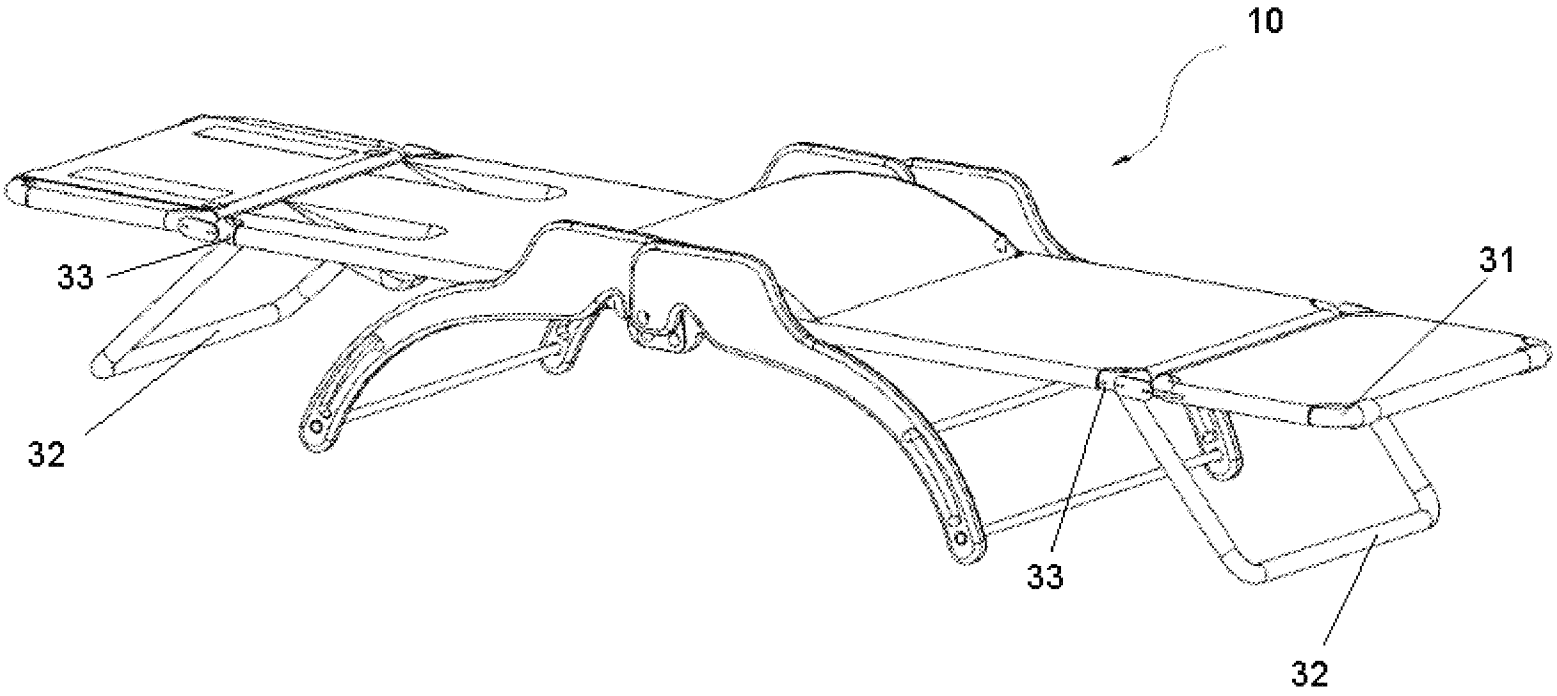
Figure 5:
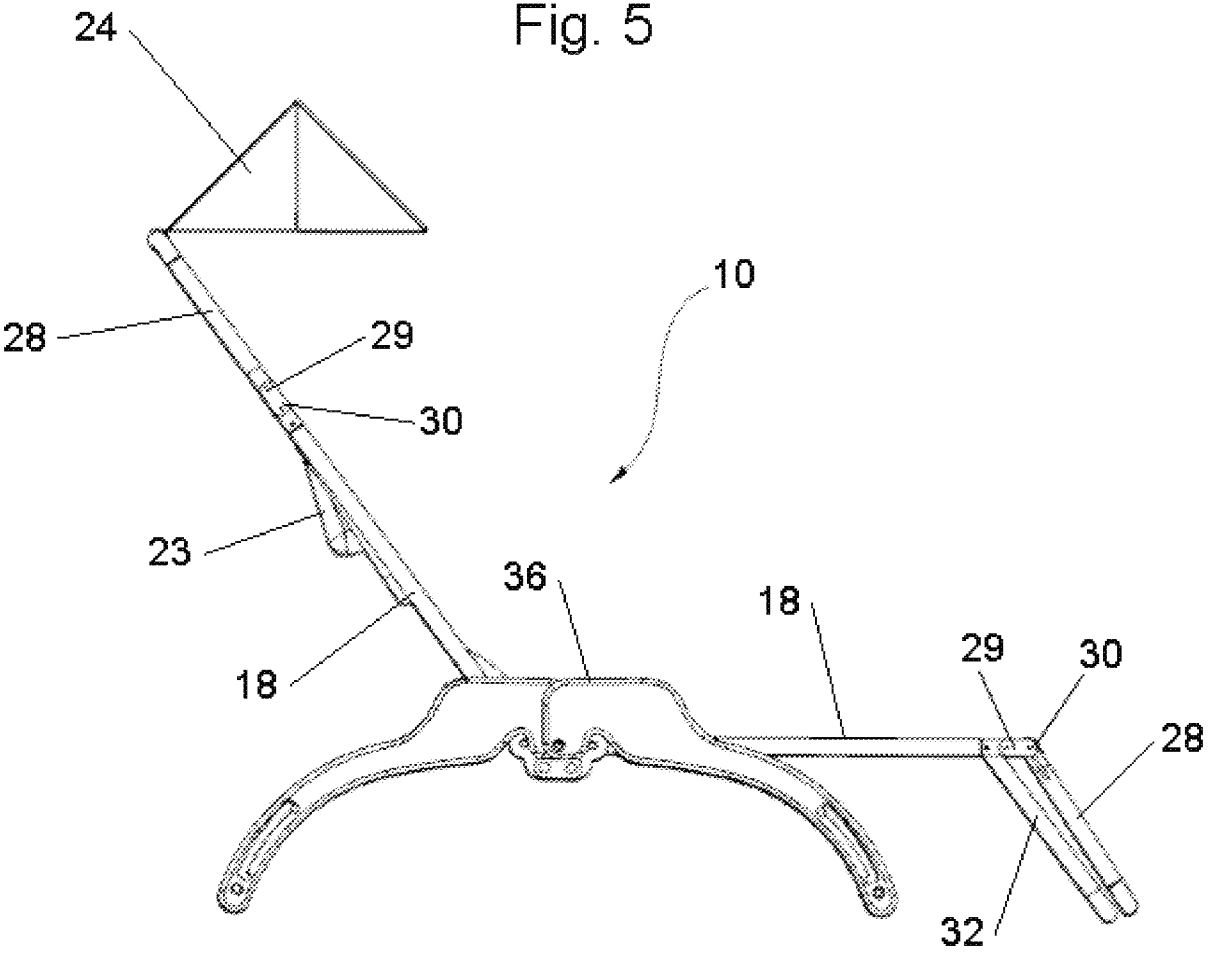
Figure 6:
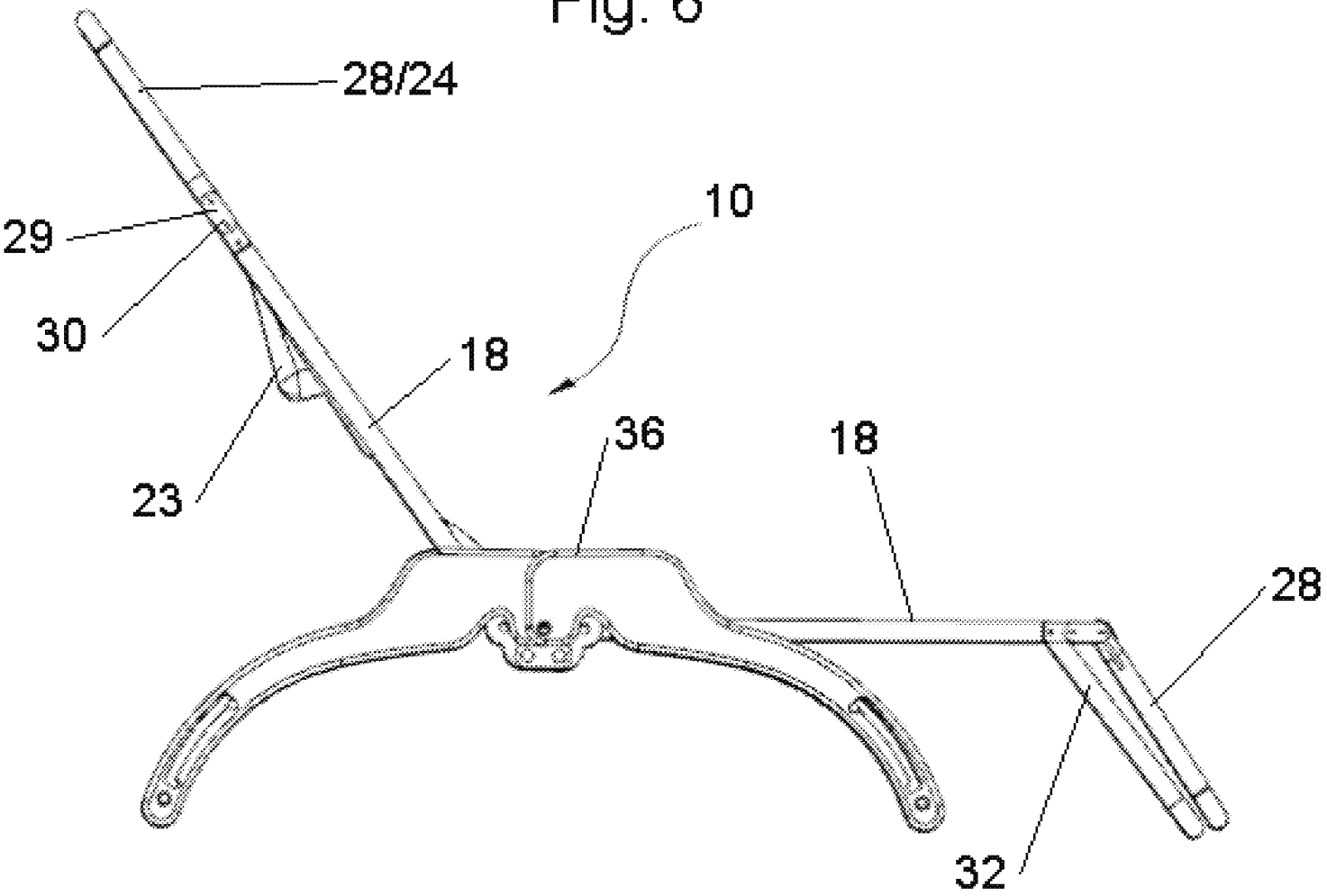
Figure 7:
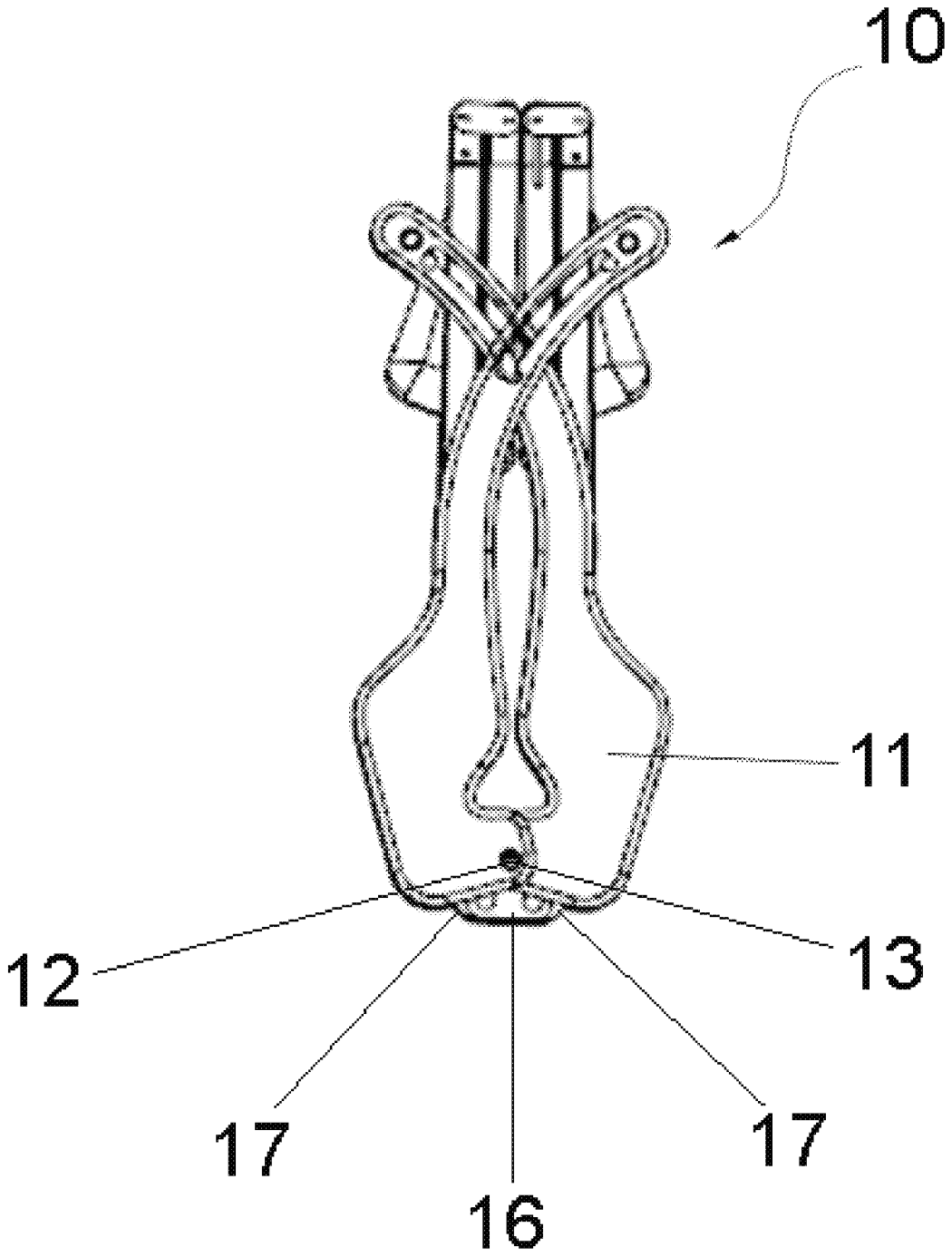
Figure 8:
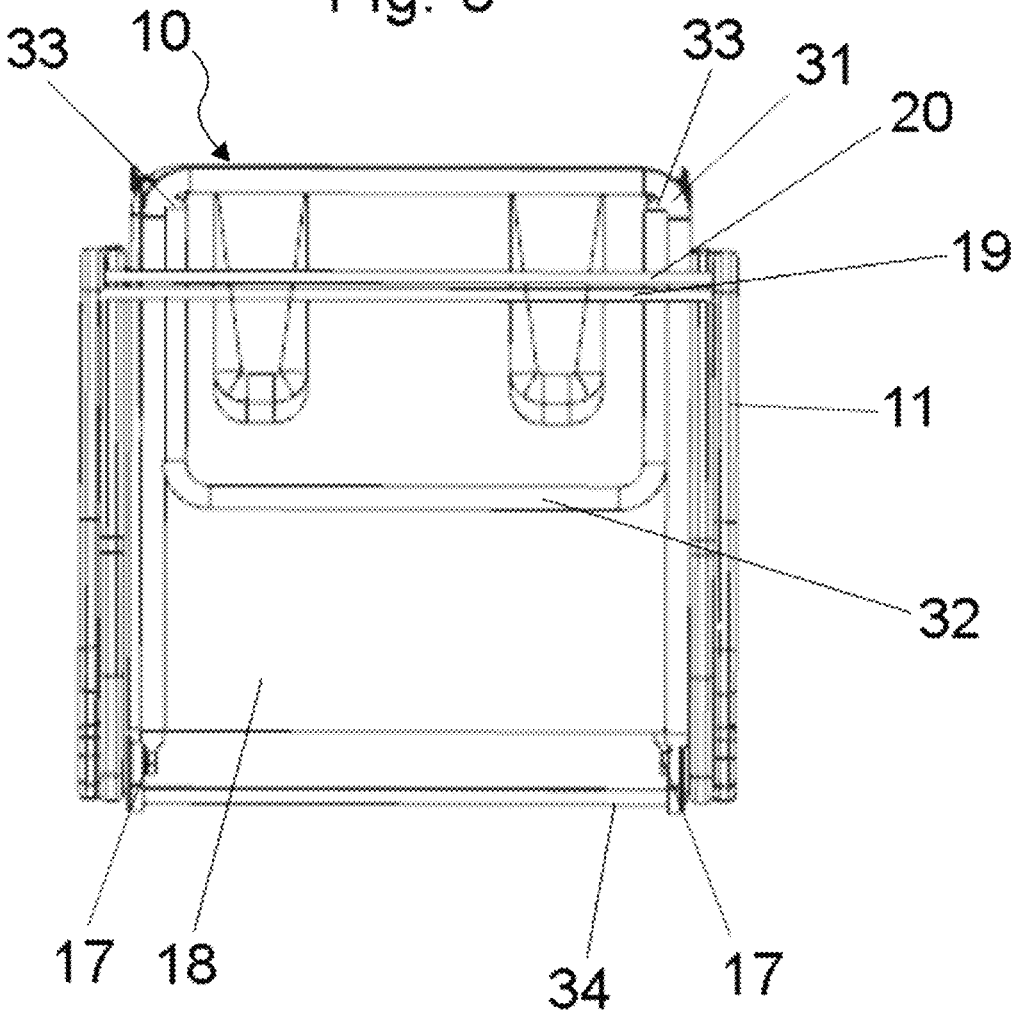
Figure 9:
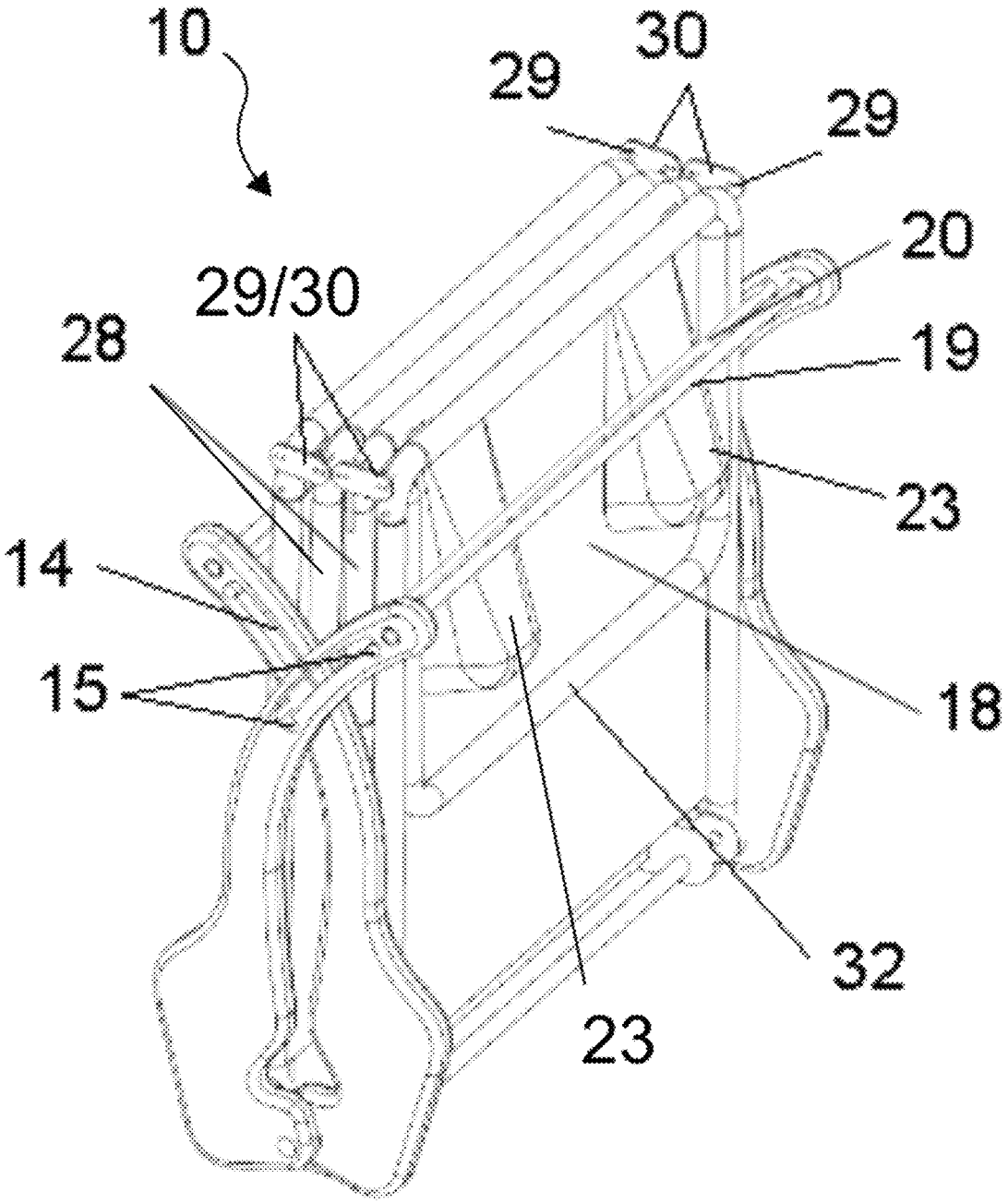
Figure 10:
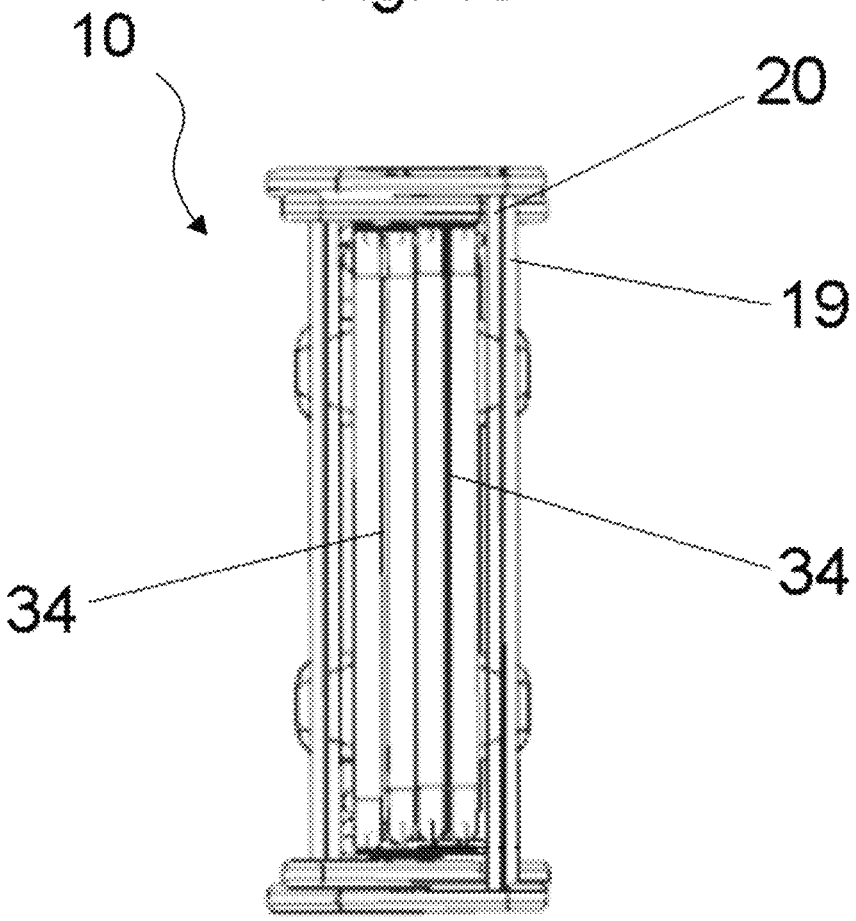
Figure 11:
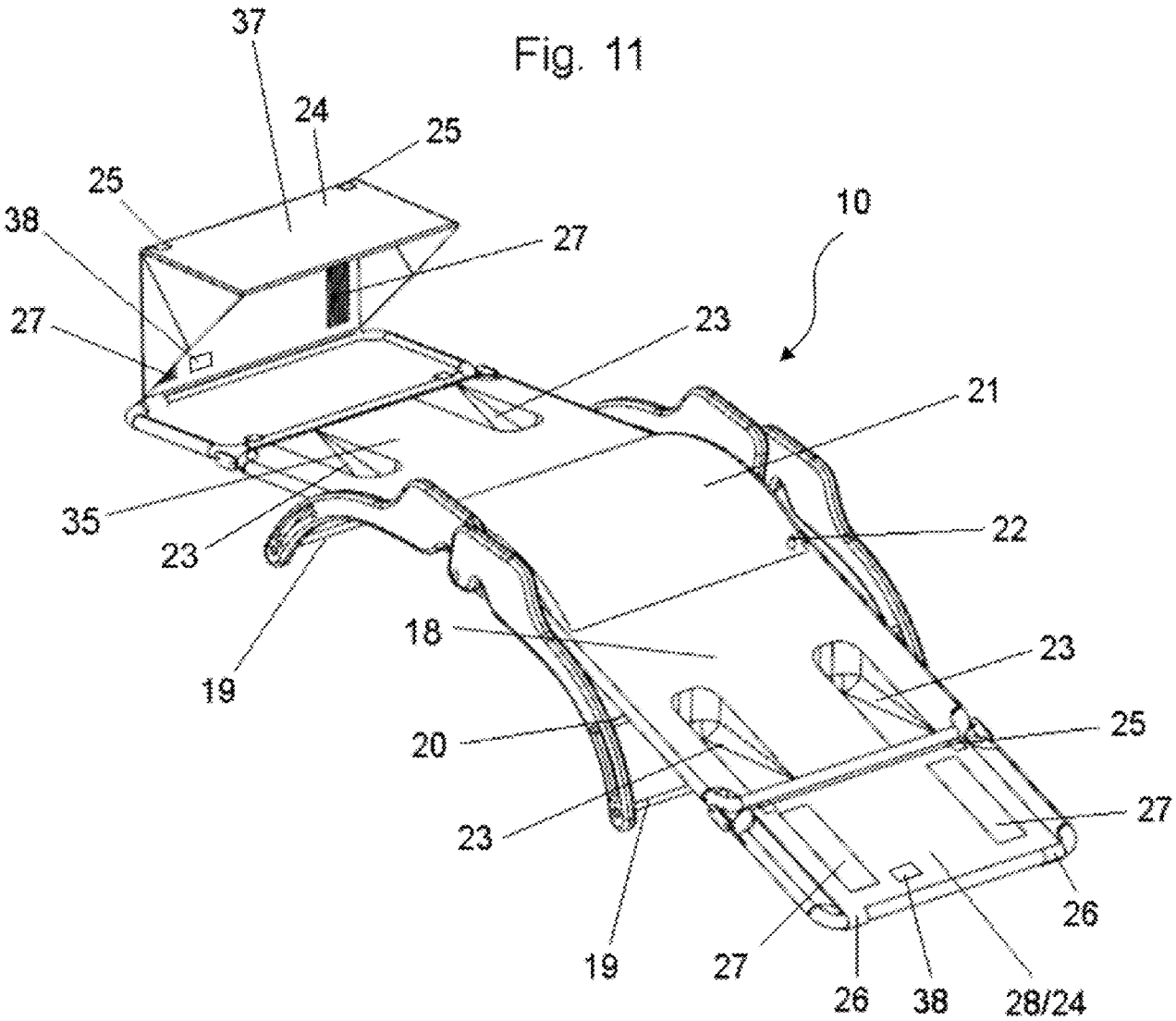
Figure 12:
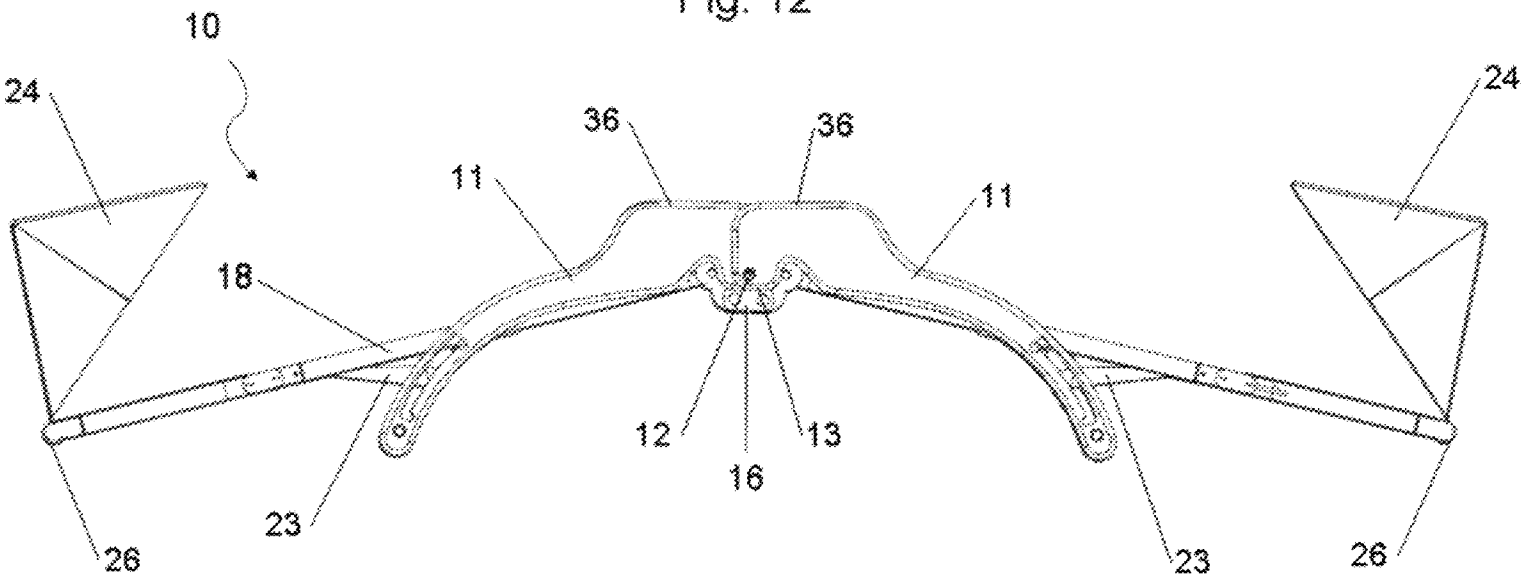
Figure 13:
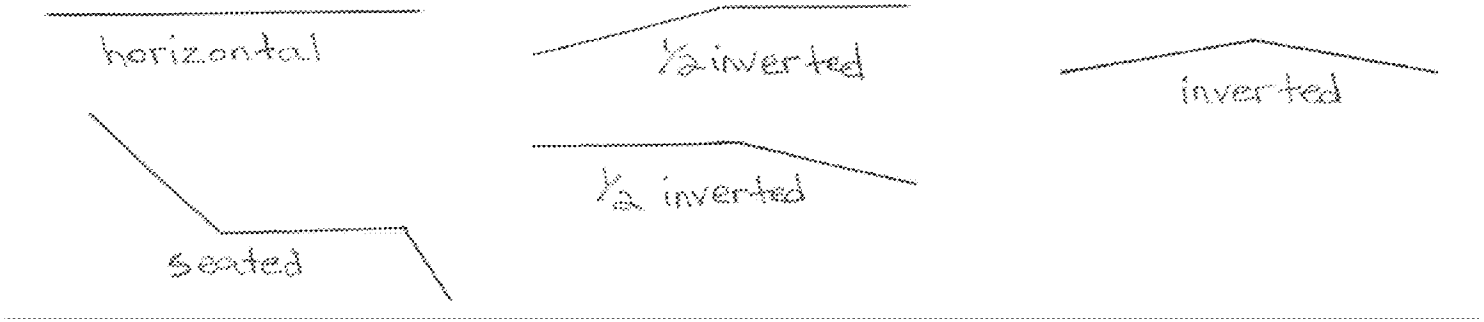

Having thus described embodiments of the present invention in general terms, reference will now be made to the accompanying drawings, which are not necessarily drawn to scale, and wherein:

FIG. 1 shows a perspective view of a chair in accordance with embodiments of the present invention;

FIG. 2 shows a perspective view of a chair in accordance with embodiments of the present invention;

FIG. 3 shows a perspective view of a chair from underneath the sitting surface in accordance with embodiments of the present invention;

FIG. 4 shows a perspective view of a chair in accordance with embodiments of the present invention;

FIG. 5 shows a side view of a chair in accordance with embodiments of the present invention;

FIG. 6 shows a side view of a chair in accordance with embodiments of the present invention;

FIG. 7 shows a side view of a chair in accordance with embodiments of the present invention;

FIG. 8 shows a back/front view of a chair in accordance with embodiments of the present invention;

FIG. 9 shows a perspective view of a chair in accordance with embodiments of the present invention;

FIG. 10 shows a bottom view of a chair in accordance with embodiments of the present invention;

FIG. 11 shows a perspective view of a chair in accordance with embodiments of the present invention;

FIG. 12 shows a side view of a chair in accordance with embodiments of the present invention; and FIG. 13 shows side views of some of the positions achievable with the chairs in accordance with embodiments of the present invention.

DETAILED DESCRIPTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa unless explicitly stated otherwise. Also, as used herein, the term "a" and/or "an" shall mean "one or more," even though the phrase "one or more" is also used herein. Like numbers refer to like elements throughout. Descriptors such as "top", "bottom" and "side" as used herein are understood to refer to parts of the chair of the present invention as they would be positioned during normal use.

Embodiments of the present invention relate generally to chairs. The chairs are generally meant to be used outdoors, and some embodiments of the invention are directed to portable or folding chaise lounge chairs. More particularly, embodiments of the invention provide a chair with a back comprising a media compartment with a collapsible shade and ventilation, a solar powered media charging station, and lumbar support in seated positions. In some embodiments, the chair includes arms or arm rests. In some embodiments, the chair lacks arms or arm rests.

In some embodiments, the chair is a folding chair. In some embodiments, the chair is portable. In some embodiments, the portability is supplied via rollers or wheels on at least some of the parts of the chair that touch the ground.

In some embodiments, the chair comprises a media compartment that lies flush against the back section of the chair (the section against which a user's head or back would lean against when in a seated position) and is pivotally connected to the distal end of the back section, which compartment pivots open (for example, with a tension joint) to store any type of the user's media. Affixed to and folded inside the media compartment is a collapsible shade to provide shade and comfort for the user's eyes when viewing the user's media and to provide shade for the user's head and upper body in all positions. The collapsible shade is ventilated and adjustable to any position ranging from being fully closed to being fully extended to provide maximum shade.

In some embodiments, the chair comprises a solar energy generating technology that also serves as part of the outside surface of the collapsible shade and that is connected to a media charging station contained in the media compartment.

In some embodiments, the chair is a lounge chair. The lounge chair comprises two main body support sections. The lounge chair further comprises lumbar support in the supine and seated positions. In at least some embodiments, the lounge chair further comprises allowing at least one main body support section to decline below or beyond the horizontal for an extended, inverted prone position, having an inflatable/padded mid-section support, and elbow pockets.

In some embodiments, the chair is a folding lounge chair. In some embodiments, the lounge chair is portable. In some embodiments, the portability is supplied via rollers or wheels on at least some of the parts of the lounge chair that touch the ground.

The lounge chair, folding lounge chair, sand chair, and elevated chair offer a variety of positions to the user. Some of the positions achievable with the chairs of the invention are shown in the sketches of side views of embodiments of chairs of the invention presented in FIG. 13.

The variety of positions can be obtained and maintained via any mechanism known to one of skill in the art. Described herein as one embodiment is a lockable hinged construction, or ratchet joint, holding together the chair sections. Other embodiments include a hook and bar mechanism for locking the chair in different positions, as would be known by one of ordinary skill in the art.

The lounge chair of the invention provides an inverted prone position for passively stretching the lounger's spinal column and for greater comfort while reading, watching kids, having a conversation, and enjoying the scenery, with reduced stress on the lounger's neck and back in the prone position.

In some embodiments, the inflatable or padded mid-section/lumbar support is provided by a device such as an inflatable or padded pouch across the fulcrum of the chair to support the lounger's mid-section in the horizontal prone and inverted prone positions and the lumbar spine in the supine and all seated positions. The inflatable support pouch is easily adjusted by increasing or decreasing the amount of air in the pouch.

In some embodiments, the lounge chair of the invention provides the elbow pockets, media compartment and shade, and solar power generating technology and media charging station on the chair on both main body support sections, making the chair completely reversible and giving it two charging stations for the user's extended media usage.

In some embodiments, the pair of elbow pocket/channels are provided on a main body support section that lies below the plane of the main body support section and tapers in depth, but remains constant in width, to the end of the main body support section, away from the body of the lounger, for lowering and supporting the lounger's elbows and forearms while reading, watching kids, having a conversation, and enjoying the scenery in the horizontal prone and inverted prone positions, with reduced stress on the lounger's neck and back.

In some embodiments, the lounge chair of the invention comprises the pair of elbow pockets, media compartment and shade, and solar power generating technology and media charging station on the chair on both main body support and end support sections, making the chair completely reversible and giving it two charging stations for the user's extended media usage. In some embodiments, the reversible chair is a folding lounge chair.

In some embodiments, the chair of the invention is a sand chair (seat height less than 9") that sits closer to the ground than a standard chair (seat height 10"-15"). The stature of the sand chair is usually achieved with a leg length that is shorter than that of a standard chair, resulting in a seat height that is lower than that of a standard chair. In some embodiments, the sand chair is a folding chair. In some embodiments, the sand chair is a lounge chair. In some embodiments, the sand chair is a folding lounge chair. In some embodiments the sand chair comprises the horizontal, inverted, and seated positions, the inflatable/padded mid-section and/or lumbar support, and/or the pair of elbow pockets, and/or media compartment and shade, and/or solar generating technology and media charging station on the back section of the chair.

In some embodiments, the chair of the invention is a chair that is elevated (seat height 16" or higher), so that the seat of the chair is situated at a position more raised from the ground than a standard chair (seat height 10"-15") for the convenience of older or less mobile users. The stature of the elevated chair is usually achieved with a leg length that is longer than that of a standard chair, resulting in a seat height that is higher than that of a standard chair. In some embodiments, the elevated chair is a folding chair. In some embodiments, the elevated chair is a lounge chair. In some embodiments, the elevated chair is a folding lounge chair. In some embodiments the elevated chair comprises the horizontal, inverted, and seated positions, the inflatable/padded mid-section and/or lumbar support, and/or the pair of elbow pockets, and/or media compartment and shade, and/or solar power generating technology and media charging station on the back section of the chair.

The present invention provides a chair that is useful for outdoor recreation and relaxation. The chair provides features that enhance the enjoyment of the user, such as a media compartment with a pop out/collapsible shade, solar powered media charging station, horizontal, inverted, and multiple seated positions, mid-section/lumbar support, and elbow pockets. It is understood by those of ordinary skill in the art that any combination of the features described herein can be included in an embodiment of the chair of the present invention.

The chair can be made of any suitable material, such as plastic, metal, and fabric. In some embodiments, the seating area is plastic. In some embodiments, the seating area is a fabric. The seating area can be made from any suitable material. In some embodiments, the seating area material is a reinforced fabric. In some embodiments, the seating area material is treated (for example, with a coating) to better withstand outdoor conditions. In some embodiments, the material is a natural fabric. In some embodiments, the material is a synthetic fabric. One example of a synthetic fabric meant for outdoor use is Sunbrella® fabric.

In some embodiments, the media compartment with a collapsible shade is pivotally connected to a distal end of an end support section. The shade can be made from any suitable material. In some embodiments, the shade material is a reinforced fabric. In some embodiments, the shade material is treated (for example, with a coating) to better withstand outdoor conditions. In some embodiments, the material is a natural fabric. In some embodiments, the material is a synthetic fabric. One example of a synthetic fabric intended for outdoor use is Sunbrella® fabric.

The media compartment has a ventilation system incorporated within it, as well as the collapsible shade, which provides support and shaded reading of all types of media in any position, including the horizontal and inverted prone positions. In some embodiments, the ventilation system includes flaps that open and close. In some embodiments, the ventilation system includes slits in the material. In some embodiments, the ventilation system includes mesh material. The media compartment and collapsible shade also serve as an overhead shade in all positions or can be closed in all positions. In at least some embodiments, the ventilation system is located on the shade such that when the shade is fully extended, the ventilation system is located on the top surface, or the surface located above the user's head.

The media compartment collapsible shade comprises a solar power producing technology such that the outside surface of the collapsible shade provides power to the media charging station contained in the media compartment. The media charging station is suitable for any personal electronics device, including but not limited to, cellular phone devices, MP3 music players (such as iPods®), reading devices (such as Kindles® and Nooks®), computer notebooks and tablets (such as iPads®), gaming devices and digital cameras.

In some embodiments, the chair is a lounge chair. In some embodiments, the chair is a portable/folding chaise lounge chair. Discussed below are exemplary embodiments of the lounge and folding lounge chairs, but one of ordinary skill in the art recognizes that many different configurations are possible for fastening together the parts of a lounge or folding lounge chair, and such configurations are in no way meant to be limiting to the scope of the present invention.

The lounge chair comprises a framework, a flexible material associated with and attached to the framework, for supporting a human body, and two main body support sections, each pivotally connected to adjustable multiple-position locking joints on either side of the chair, which joint is affixed to a plate on either side of the chair.

The plate on either side of the chair is connected to two inverted, modified U-shaped supports/legs on either side of the chair. Two crossbars are affixed to the plate on either side of the chair, below the horizontal plane of the two main body support sections, at the fulcrum of the chair. The two main body support sections move independently to adjust to multiple seated, supine, and prone positions above and below the horizontal and including the horizontal. Crossbars or other structural features provide support to the two main body support sections in the inverted prone position. A crossbar is affixed to the distal ends of the inverted, modified U-shaped supports/legs on either side of the lounge chair. Another crossbar is affixed a distance proximal from the crossbar at the distal ends of the inverted, modified U-shaped supports/legs on either side of the lounge chair. Two fold down leg supports are pivotally connected to the distal ends under the two main body support sections for support in the horizontal and multiple seated positions.

In some embodiments, the invention comprises a folding lounge chair, which comprises a framework, a flexible material associated with and attached to the framework for supporting a human body, and two main body support sections, each pivotally connected at a fulcrum to multiple position, locking joints on either side of the chair, which joints are affixed to a plate on either side of the chair.

The folding lounge chair further comprises two folding supports/legs on either side of the chair, pivotally connected to the plates, two crossbars at the fulcrum, below the plane of the main body support sections and affixed to the plates on either side of the chair, two crossbars/supports affixed to the distal ends of the supports/legs, two movable crossbars/supports which move inside slots in the main supports/legs for support in the inverted prone position, and two fold down legs under the two main body support sections for support in the horizontal and seated positions. Each main body support section has a pivotally connected end support section.

The mid-section/lumbar support device is self-contained in the chair. That is to say, the mid-section/lumbar support device is attached to, or built into, the chair. In some embodiments, the mid-section/lumbar support device is a pouch that comprises an airtight pouch made of a flexible material, which is attached on all sides onto the flexible material of a main body support section, a certain distance from the fulcrum of the chair, across the main body support section and the fulcrum, above the plane of the fixed crossbars at the fulcrum, and continuing a certain distance onto the other main body support section. The pouch can be air inflated by the lounger through the air fill valve or filled with a variety of malleable substances. In some embodiments, the pouch comprises a padded material. The padded material can be, but is not limited to, foam material, such as memory foam, or other material for padding, such as a lofted material. Any malleable padded material could be used.

At least one of the two main body support sections of the lounge chair and folding lounge chair declines below the horizontal, resting on the fixed/movable crossbars/supports in the locked open position. In some embodiments, both of the two main body support sections decline below the horizontal such that, in combination with the inflatable/padded pouch across the fulcrum, a soft inverted U-shape is created. Lying prone in this inverted position allows the slow, gentle stretching of the lounger's entire spinal column. The pouch also serves as a lumbar support in the supine and multiple seated positions.

In some embodiments, two elbow pockets are contained in a main body support section, such that they are curved on the proximal end and protrude below the horizontal plane of the main body support section, tapering in depth but with constant width, to the distal end of the main body support section. The pockets allow the lounger's elbows and forearms to be lowered and supported in the horizontal prone and inverted prone positions for comfortable reading, watching kids, having a conversation, and enjoying the scenery, all with reduced stress on the lounger's neck and back.

Any one of, or desired combination of, the features above can be contained on each main body support and end support section, making the lounge chair reversible.

Now referring to the drawings, FIG. 1 shows a lounge chair (40) according to some embodiments of the invention which includes a framework (31), covered with a flexible material (35), and two main body support sections (18). An airtight pouch (21) is provided that can be air inflated or padded and which serves as a support in the horizontal and inverted prone positions and a lumbar support in the seated and supine positions. A pouch air fill valve (22) is provided for the inflatable support embodiment. The degree of inflation of the inflatable pouch is easily adjusted to suit the user's needs by increasing or decreasing the amount of air held in the pouch.

Elbow pockets or channels (23) are contained in, or part of, a continuation of the flexible material (35) of a main body support section (18), being curved on their proximal ends and running a depth below the plane of the flexible material (35) of the main body support section (18), beginning a distance from the fulcrum and continuing down the length of the remainder of the main body support section (18), parallel to the sides of the main body support section (18) and, with decreasing tapered depth and constant width, to the distal end of the main body support section (18). In other embodiments, the pockets or channels (23) are made of a different material than the material (35) of the main body support section (18).

The elbow pockets (23) provide support and comfort for the lounger's elbows and forearms in the horizontal and inverted prone positions for reading, watching the kids, having a conversation, and enjoying the view.

A media compartment, with a collapsible shade, (24) is provided, which in this embodiment is pivotally affixed to the distal end of a main body support section (18) with, for example, a pivoting joint such as a tension joint. The collapsible shade of the media compartment (24) can fold down flat on and removably attach to the main body support section (18) with a closure mechanism (25). Incorporated into the media compartment/shade (24) is a ventilation system (27) (a mesh fabric is shown in FIG. 1; other embodiments can comprise, for example, slits in the material or flaps that open and close) to allow air to flow freely through the compartment.

In the multiple seated positions, the top surface of each support leg (41) acts as an armrest (36). Solar power producing technology (37) is provided as part of the outer surface of the collapsible shade (24), which technology is connected to a media charging station (38) contained in the media compartment/shade (24).

FIG. 2 shows a folding lounge chair (10) according to some embodiments of the invention, which includes a framework (31), covered with a flexible material (35), two main body support sections (18), two end support sections (28), and four inverted modified half U-shaped supports/legs (11). Fasteners (12) are provided for pivotally connecting two inverted modified half U-shaped supports/legs (11) on each side of the chair (10). Locking mechanisms (13) are provided for the fasteners (12) for the inverted modified half U-shaped supports/legs (11) in the open and closed positions. One of ordinary skill in the art would understand how to create various configurations of the fasteners (12) and locking mechanism (13) that would fall within the scope of the present invention.

Now referring to both of FIGS. 2 and 3, pivoting joints (17) are provided, pivotally connected on each side of the chair (10) to the two main body support sections (18) and affixed to a plate (16), which is pivotally connected (12) to the inverted modified half U-shaped supports/legs (11) on each side of the chair. Two fixed crossbars (34) are provided, which are affixed to the plates (16) below the horizontal plane of the two main body support sections (18) on either side of the chair (10). Pivoting joints (29) are provided for pivotally connecting abutting ends of the two end support sections (28) to the distal ends of the two main body support sections (18).

Locking mechanisms (30) are provided for the two end support sections' (28) pivoting joints (29). Two fixed crossbars (19) are provided between and connected to two inverted modified half U-shaped supports/legs (11), at their most distal points, on either side of the folding lounge chair (10). Movable crossbars/supports (20) are provided, fixed into slots (14) in the interior section of each inverted modified half U-shaped support/leg (11). Notched locking mechanisms (15) are provided for the movable crossbars/supports (20) in the open and closed positions.

As seen in FIGS. 2 and 3, a securing structure/pivot fastener of pivoting joints (17) allows independent and multiple positioning of each main body support member (18), above and below the horizontal and including the horizontal. This allows the chair (10) to be placed in an inverted soft U-shaped position at the lounger's mid-section, with the main body support sections (18) resting on the movable crossbars/supports (20) in the locked open position.

An airtight pouch (21) is provided that can be air inflated or padded and which serves as a mid-section support in the horizontal and inverted prone positions and a lumbar support in the seated and supine positions. A pouch air fill valve (22) is provided for the airtight pouch (21) inflatable embodiment. Elbow pockets or channels (23) are contained in, or part of, a continuation of the flexible material (35) of a main body support section (18), being curved on their proximal ends and running a depth below the plane of the flexible material (35) of the main body support section (18), beginning a distance from the fulcrum and continuing down the length of the remainder of the main body support section (18), parallel to the sides of the main body support section (18) and, with decreasing tapered depth and constant width, to the distal end of the main body support section (18).

The elbow pockets (23) provide support and comfort for the lounger's elbows and forearms in the horizontal and inverted prone positions for reading, watching the kids, having a conversation, and enjoying the view. A media compartment, with a pop out/collapsible shade, (24) is provided, which is affixed to the distal end of an end section support (28) with a pivoting joint (26) [shown here as a tension joint]. The collapsed shade folds down flat on and temporarily attaches to the proximal end of the end support section (28) with a closure mechanism (25) in the closed position. Incorporated into the media compartment/shade (24) is a ventilation system (27) (shown here as mesh, but could also be slits in the material or flaps that open and close) to allow air to flow freely through the media compartment/shade (24).

In the horizontal and seated positions, the main body support sections (18) are supported by fold down support legs (32), which are pivotally connected (33) to the underside, distal end of the framework (31) of each main body support section (18). In the multiple seated positions, the top surface of each inverted, modified half U-shaped support leg (11) acts as an armrest (36). Solar power producing technology (37) is provided as part of the outer surface of the collapsible shade (24), which technology is connected to a media charging station (38) contained in the media compartment/shade (24). The airtight pouch (21), pouch fill valve (22), elbow pockets or channels (23), media compartment/shade (24), closure mechanism (25), pivoting joint (26), ventilation system (27), solar power producing technology (37), and media charging station (38) can be situated on each half of the chair for complete reversibility and extended media usage time. (see FIGS. 11 and 12).

FIG. 4 shows an embodiment of the invention comprising a folding lounge chair in a horizontal position. As shown in FIG. 4, the fold down support leg (32) is fastened to the framework (31) by a pivoting fastener (33). When not in use, the fold down support legs (32) fold flush against the underside of each main body support section (18).

FIG. 5 shows an embodiment of the invention comprising a folding lounge chair in an upright seated position. As shown in FIG. 5, the chair comprises a media compartment and shade (24) with the shade popped out or extended, two end support sections (28), and pivoting fasteners (29) connecting the end support sections (28) to the main body support sections (18), whereby a locking mechanism (30) for the pivoting fasteners (29) is also included in the area of the pivoting fasteners (29), thus enabling each end support section (28) of the chair (10) to be lifted so that it is on the same plane as the adjacent main body support section (18) of the chair (10).

The folding lounge chair shown in FIG. 5 further comprises two elbow pockets (23), two main body support sections (18), two armrests (36), and a fold down support leg (32). FIG. 6 shows an embodiment of the invention comprising a folding lounge chair in an upright seated position that is similar to FIG. 5 except that in FIG. 6, the media compartment (24) shade is collapsed against or into the end support section (28). It is understood by one of ordinary skill in the art that there are multiple ways of storing the collapsed shade (24), all of which are encompassed by the current invention. For example, the shade (24) can be folded or collapsed against the end support section (28). In other embodiments, the shade (24) can pivot over the distal end of the end support section (28) and fold or collapse against the side of the end support section (28) that is away from the surface on which the user's head rests. One of skill in the art would understand that there are other ways of collapsing and storing shade (24), and the examples shown are not intended to limit the scope of the invention.

FIGS. 7-10 show embodiments of the invention comprising a folding lounge chair such as the chairs shown in FIGS. 2-6. In FIGS. 7-10, the folding lounge chair is shown in a folded position. FIG. 7 shows a side view of an embodiment of the chair in a folded position, wherein the pivoting joint (12) connecting the inverted, modified half U-shaped supports/legs (11) is visible, as is the locking mechanism (13), the plate (16) that is pivotally connected to the inverted, modified half U-shaped supports/legs (11), and the pivot joint (17) that is connected to the main body support sections (18) and affixed to the plate (16).

FIG. 8 shows a front or back view of the folding chair according to one embodiment of the invention, wherein the interior surface of the folded chair comprises the surface on which the user would sit or lie, and the exterior surface visible as shown in FIG. 8 is the underneath portion of the chair, or the side opposite that on which the user would sit or lie. Visible are features including a main body support section (18) connected to the pivot joints (17) (also see FIG. 7), a fixed crossbar (19) at distal ends of the inverted half U-shaped supports/legs (11), a movable crossbar/support (20), a fold down support leg (32), pivoting fasteners (33) to framework (31) for the fold down support leg (32), and a fixed crossbar (34) connected to the plates (16).

FIG. 9 shows a perspective view of the folding lounge chair according to one embodiment of the invention. Features that are visible in FIG. 9 include a slot (14) for sliding a moveable crossbar/support (20), lock notches (15) for moveable crossbar/support (20) for open and closed positions, a fixed crossbar (19) at distal ends of the inverted half U-shaped supports/legs (11), pivoting fasteners (29) of end support sections (28) to main body support sections (18), locking mechanisms (30) for pivoting fasteners (29), a fold down support leg (32), and elbow pockets (23).

FIG. 10 shows a bottom or lower view of the folding lounge chair according to one embodiment of the invention. Visible features include a fixed crossbar (19) at distal ends of the inverted half U-shaped supports/legs (11), a movable crossbar/support (20), and fixed crossbars (34) connected to plate (16) below the plane of the main body support sections (18).

FIGS. 11 and 12 show an embodiment of the invention comprising a reversible folding lounge chair. Many of the features are similar to the chair shown in FIGS. 2 and 3, and are discussed in the descriptions thereof. FIG. 11 shows a perspective view of an embodiment of a reversible folding chair, including an airtight pouch (21) that can be air inflated or padded and which serves as a support in the horizontal and inverted prone positions and a lumbar support in the seated and supine positions. A pouch air fill valve (22) is provided for the airtight pouch (21) inflatable embodiment. Elbow pockets or channels (23) are contained in or structured as a part or a continuation of the flexible material (35) of the main body support sections (18).

The elbow pockets (23) provide support and comfort for the lounger's elbows and forearms in the horizontal and inverted prone positions for reading, watching kids, having a conversation, and enjoying the view. Media compartments, with pop out/collapsible shades, (24) are affixed to the distal end of each end support section (28) with pivoting joints (26) (for example, a tension joint). The collapsed shade folds down flat on and temporarily attaches to the proximal end of the end support section (28) with a closure mechanism (25) in the closed position. Incorporated into the media compartment/shade (24) is a ventilation system (27) (shown here as mesh, but could also be slits in the material or flaps that open and close) to allow air to flow freely through the compartment.

In the horizontal and seated positions, the main body support sections (18) are supported by fold down support legs (32), which are pivotally connected (33) to the underside, distal end of the framework (31) of each main body support section (18). In the multiple seated positions, the top surface of each inverted, modified half U-shaped support leg (11) acts as an armrest (36). Solar power producing technology (37) on the outer surface of the collapsible shade (24) is provided, which technology is connected to a media charging station (38) contained in the media compartment/shade (24). The airtight pouch (21), pouch fill valve (22), elbow pockets or channels (23), media compartment/shade (24), closure mechanism (25), pivoting joint (26), ventilation system (27), end support sections (28), pivoting fasteners (29), locking mechanism (30), solar power producing technology (37), and media charging station (38) can be situated on each half of the chair for complete reversibility and extended media usage time.

FIG. 12 shows a side view of an embodiment of the folding lounge chair. As can be seen in FIG. 12, the media compartment/shades (24) are popped out or fully extended in an open position at each end of the chair. A pivot joint (26) of media compartment (24) is shown. The pivot joint can be of any known structure, such as but not limited to a tension joint. The elbow pockets (23) are visible, as are two inverted, modified half U-shaped support/legs (11). The inverted, modified half U-shaped supports/legs (11) are connected to the chair at pivoting joint (12), wherein the pivoting joint (12) connects to the inverted, modified half U-shaped legs (11) and a locking mechanism (13) of the inverted, modified half U-shaped legs (11) serves to lock the legs securely into position when the chair (10) is in an open position ready for use. In some embodiments, the lock has a push button mechanism for actuating and releasing. The upper surfaces of the inverted, modified half U-shaped legs (11) serve as armrests (36).

Specific embodiments of the invention are described herein. Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A chair comprising:

a first body portion having a proximal end and a distal end, the first body portion defining a pair of elongated elbow pockets, each of the elbow pockets having a longitudinal axis extending in a direction from the proximal end to the distal end of the first body portion;

a second body portion having a proximal end and a distal end, the first body portion and the second body portion connected at their proximal ends for relative pivotal movement; and a plurality of legs operatively connected to the first body portion and the second body portion, wherein the first body portion is configured to decline to a position at or below horizontal.

2. The chair of claim 1, further comprising a media compartment and a collapsible shade.

3. The chair of claim 2, wherein the collapsible shade comprises solar power producing material operatively connected to a media charging station.

4. The chair of claim 2, wherein the collapsible shade further comprises ventilation.

5. The chair of claim 4, wherein the ventilation is selected from the group consisting of flaps that open and close, slits in material of the collapsible shade, mesh, and active fan ventilation.

6. The chair of claim 1, further comprising a media charging station.

7. The chair of claim 1, further comprising a mid-section/lumbar support device.

8. The chair of claim 7, wherein the mid-section/lumbar support device is inflatable.

9. The chair of claim 1, wherein the chair is a folding lounge chair and further comprising a framework defining each of the first body portion and the second body portion, a flexible material associated with and attached to the framework for supporting a human body, and to multiple position locking joints disposed on either side of the framework and operatively connected to the first body portion and the second body portion.

10. The chair of claim 9, wherein the joints are affixed to a plate on either side of the framework.

11. The chair of claim 1, wherein the framework includes sides of the first body portion and the second body portion and the sides extend from the proximal end to the distal end of the first and second body portions, and wherein the longitudinal axis of the elbow pockets are parallel to the sides of the first body portion and have a decreasing tapered depth and a constant width from the proximal end to the distal end of the elbow pockets.

12. The chair of claim 1, wherein the chair has an elevated height compared to a standard chair.

13. The chair of claim 1, wherein the chair has a lower height compared to a standard chair.

14. The chair of claim 1, further comprising inverted modified half U-shaped support legs.

15. A chair comprising:

a framework covered with a flexible material;

two main body support sections connected at a pivot point, wherein each of the main body support sections are configured to decline to or below horizontal; and elongated elbow pockets formed in the flexible material of at least one of the main body support sections, each of the elbow pockets having a longitudinal axis extending in a direction from the proximal end to the distal end of the first body portion.

16. The chair of claim 15, further comprising:

two end support sections, each end support section connected at a distal end of the main body support section opposite to the pivot point between the two main body support sections; and a media compartment shade connected to at least one of the end support sections.

17. The chair of claim 15, further comprising solar power producing material operatively connected to a media charging station.

18. The chair of claim 15, further comprising an inflatable/padded mid-section/lumbar support device positioned over the pivot point.

* * * * *